US009437981B2

(12) United States Patent
Wu et al.

(10) Patent No.: US 9,437,981 B2
(45) Date of Patent: Sep. 6, 2016

(54) CABLE CONNECTOR ASSEMBLY WITH IMPROVED GROUNDING STRUCTURE

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/584,063

(22) Filed: Dec. 29, 2014

(65) Prior Publication Data

US 2015/0207274 A1 Jul. 23, 2015

(30) Foreign Application Priority Data

Jan. 17, 2014 (CN) ..... 2014 1 0021800

(51) Int. Cl.
*H01R 13/6597* (2011.01)
*H01R 4/02* (2006.01)
*H01R 13/405* (2006.01)

(52) U.S. Cl.
CPC ..... *H01R 13/6597* (2013.01); *H01R 4/023* (2013.01); *H01R 13/405* (2013.01)

(58) Field of Classification Search
USPC ..... 439/98, 607.47, 579, 867; 174/88 R, 174/88 C, 250; 29/843
See application file for complete search history.

(56) References Cited

U.S. PATENT DOCUMENTS

| | | | | |
|---|---|---|---|---|
| 6,380,485 | B1 * | 4/2002 | Beaman et al. | 174/88 R |
| 6,489,563 | B1 * | 12/2002 | Zhao et al. | 174/88 C |
| 7,052,292 | B2 * | 5/2006 | Hsu et al. | 439/98 |
| 7,214,097 | B1 * | 5/2007 | Hsu et al. | 439/607.47 |
| 7,670,154 | B2 * | 3/2010 | Yu et al. | 439/98 |
| 7,819,675 | B2 * | 10/2010 | Ko et al. | 439/98 |
| 9,105,375 | B2 * | 8/2015 | Sugiyama | |
| 9,190,769 | B2 * | 11/2015 | Nonen | |
| 2013/0161071 | A1 * | 6/2013 | Kodama et al. | 174/250 |

* cited by examiner

*Primary Examiner* — Alexander Gilman
(74) *Attorney, Agent, or Firm* — Ming Chieh Chang; Wei Te Chung

(57) ABSTRACT

A cable connector assembly comprises a pair of cables each having two conductive wires, a grounding layer, and an outer jacket. The connector is electrically connected with the cables and has an insulative housing and a number of electrical contacts retained to the insulative housing. The electrical contacts include plural signal contacts electrically connected with the conductive wires, plural grounding contacts, and plural grounding pins backwardly integrally extending from the grounding contacts. The grounding pin is disposed between the outer jacket and the grounding layer to electrically connect with the grounding layer.

7 Claims, 6 Drawing Sheets

CABLE CONNECTOR ASSEMBLY WITH IMPROVED GROUNDING STRUCTURE

BACKGROUND OF THE INVENTION

1. Field of the Invention

The present invention relates to a cable connector assembly, and more particularly to an improved grounding structure thereof 2. Description of Related Art U.S. Pat. No. 6,489,563, issued on Dec. 3, 2002, discloses a cable connector assembly comprising an electrical connector, a pair of cables electrically connected with the electrical connector, an outer jacket surrounding the pair of cables to leave respective front portions of the pair of cables exposed to outside, and a grounding sleeve. The electrical connector comprises an insulative housing with a plurality of electrical contacts assembled therein. The electrical contacts comprise a plurality of signal contacts and a plurality of grounding contacts. Each cable comprises two signal wires, a metal braid wrapping around the two signal wires. The grounding sleeve defines two recess portions for corresponding metal braids of the cables to be press-fitted therein and a plurality of grounding pins electrically connected with corresponding grounding contacts by soldering. Here, the grounding sleeve is provided for interconnecting the grounding wires to the cable in order to reduce production cost and simplify manufacturing process and soldering procedure. However, the extra piece of element, namely the grounding sleeve, increases a length of the cable connector assembly.

A cable connector assembly with an improved grounding structure is desired.

BRIEF SUMMARY OF THE INVENTION

Accordingly, an object of the present invention is to provide a cable connector assembly having an improved grounding structure.

In order to achieve the above-mentioned object, a cable connector assembly in accordance with the present invention comprises: a pair of cables each having two conductive wires, a grounding layer, and an outer jacket; a connector electrically connected with the cables and comprising an insulative housing and a plurality of electrical contacts retained to the insulative housing, the plurality of electrical contacts comprising plural signal contacts electrically connected with the conductive wires, plural grounding contacts, and plural grounding pins backwardly integrally extending from the grounding contacts, each grounding pin disposed between the outer jacket and the grounding layer to electrically connect with the grounding layer.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
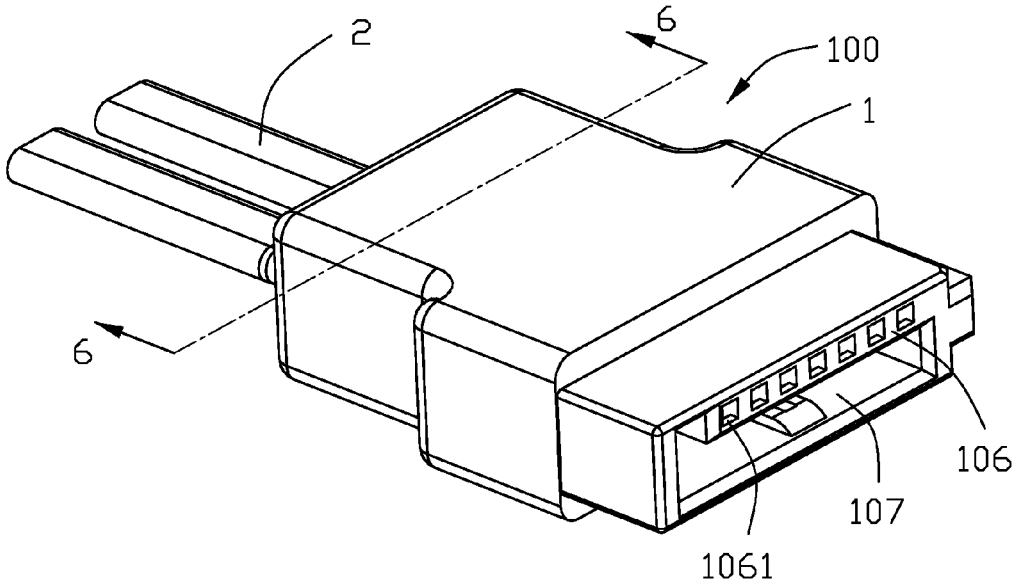
FIG. 1 is a perspective view of a cable connector assembly according to the present invention.
Figure 2:
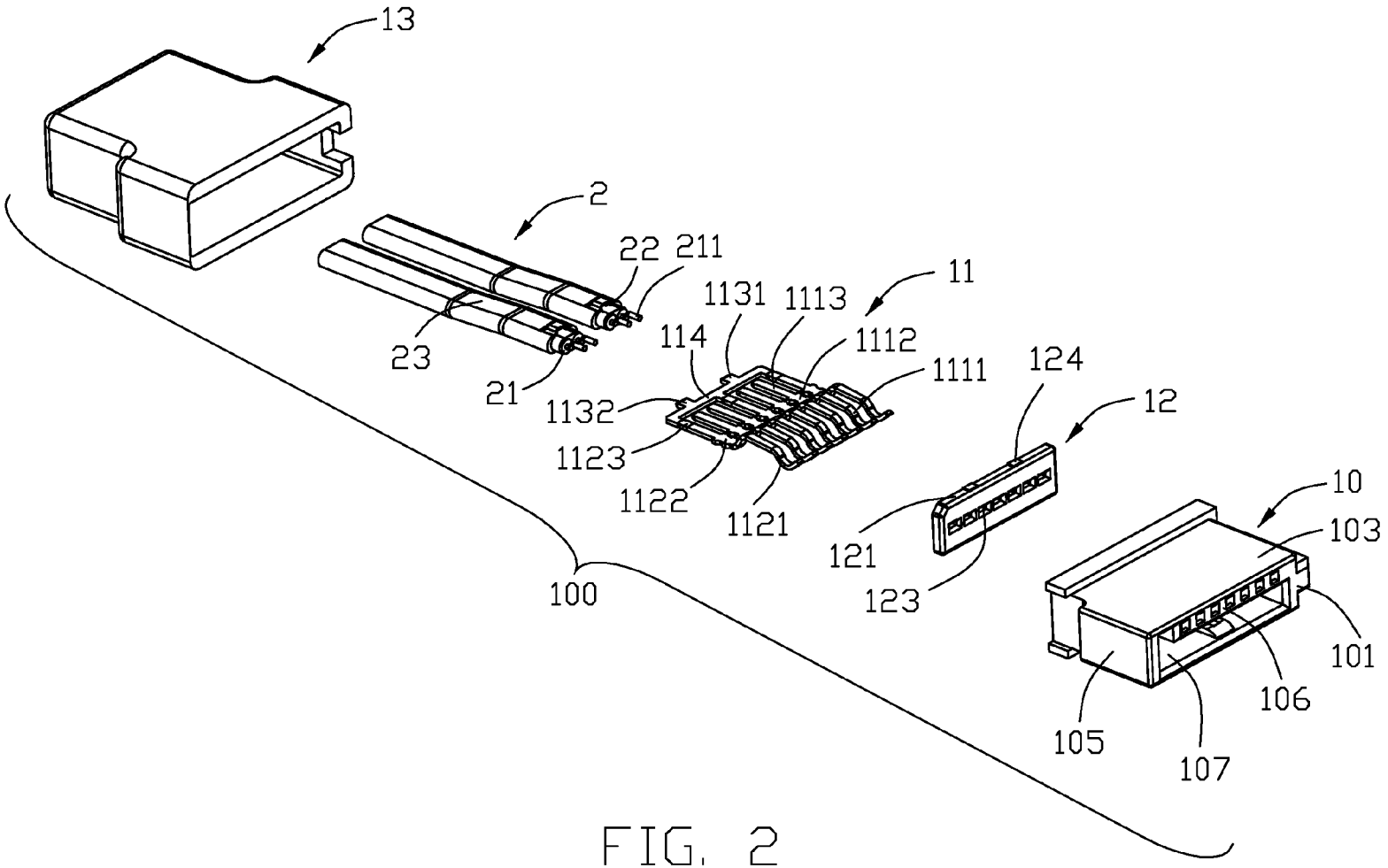
FIG. 2 is an exploded view of the cable connector assembly shown in FIG. 1.
Figure 3:
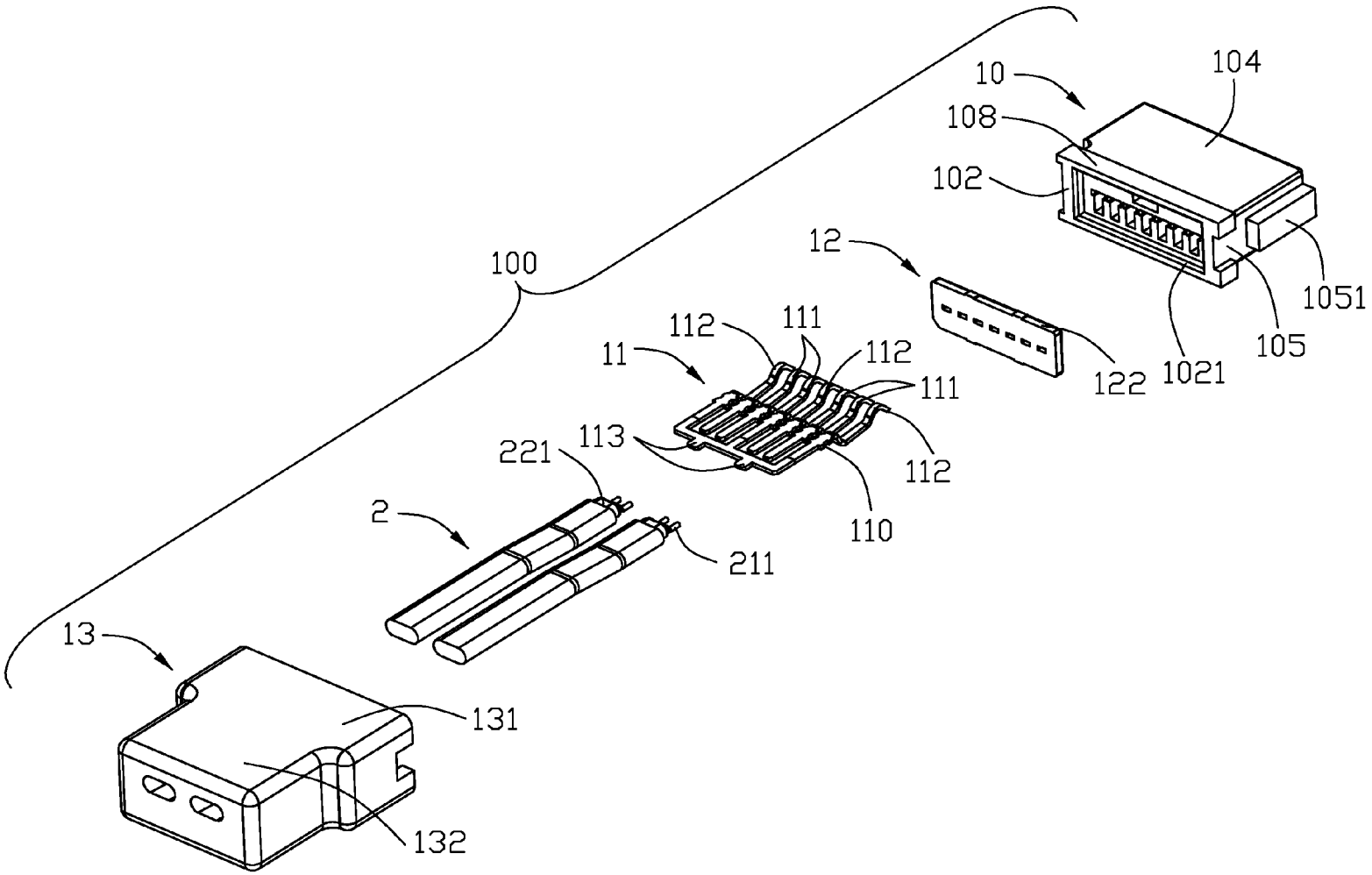
FIG. 3 is an exploded view of the cable connector assembly shown in FIG. 1 from another aspect.
Figure 4:
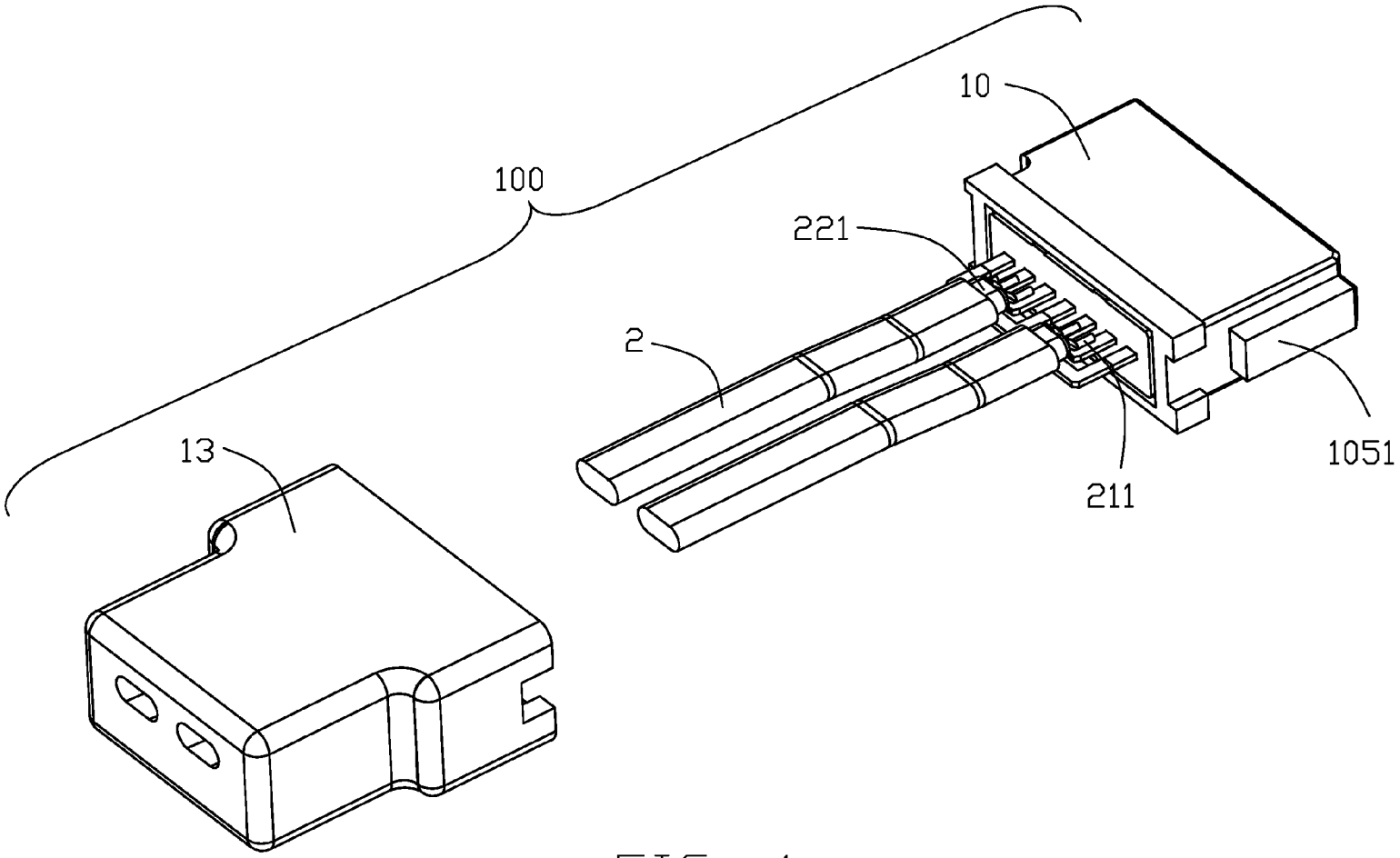
FIG. 4 is a partly exploded view of the cable connector assembly shown in FIG. 1, wherein conductive wires are shown soldered to corresponding signal contacts.
Figure 5:
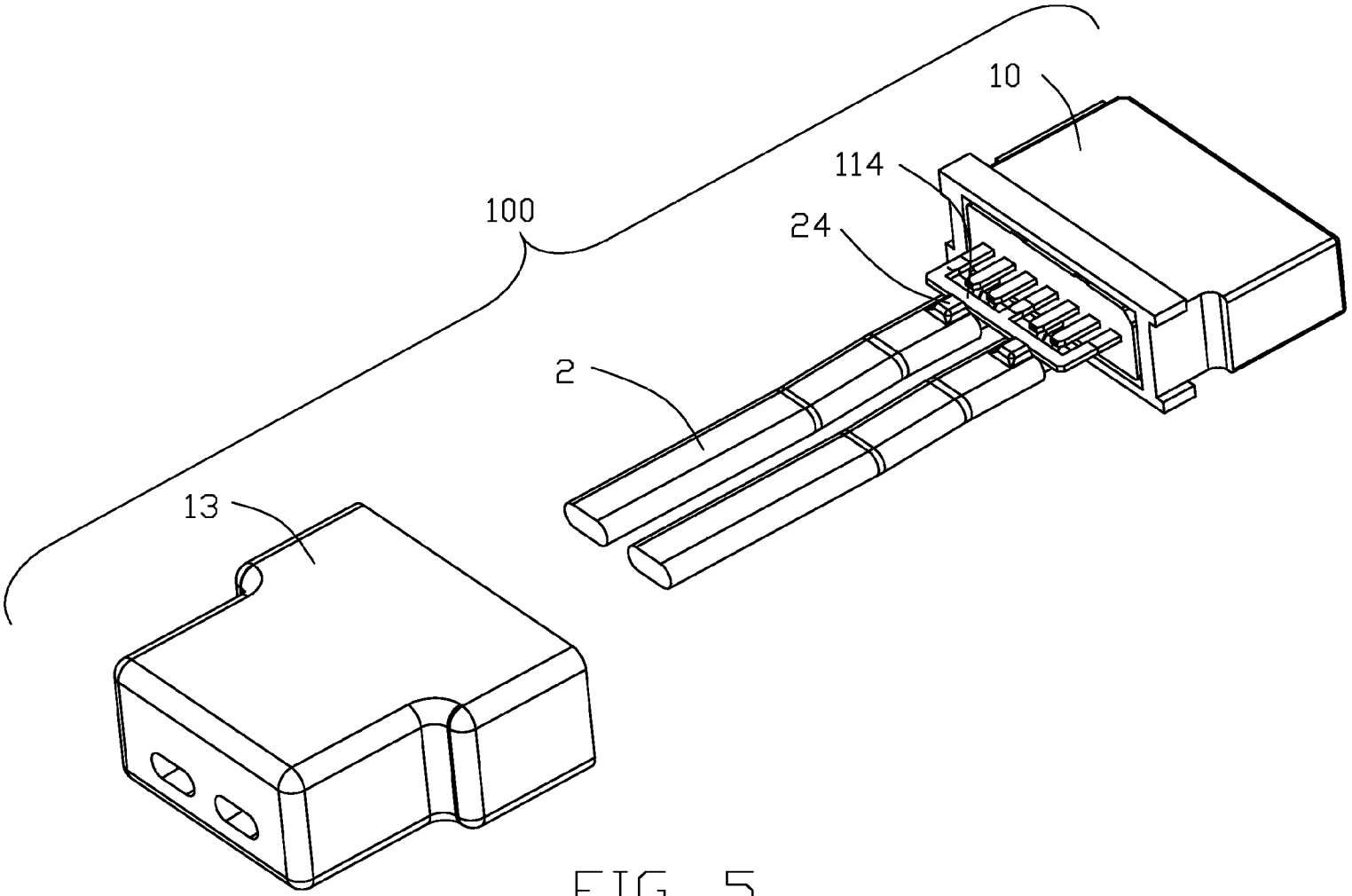
FIG. 5 is a partly exploded view of the cable connector assembly shown in FIG. 1, wherein grounding pins are shown inserted into and disposed between cable outer jacket and grounding layer.
Figure 6:
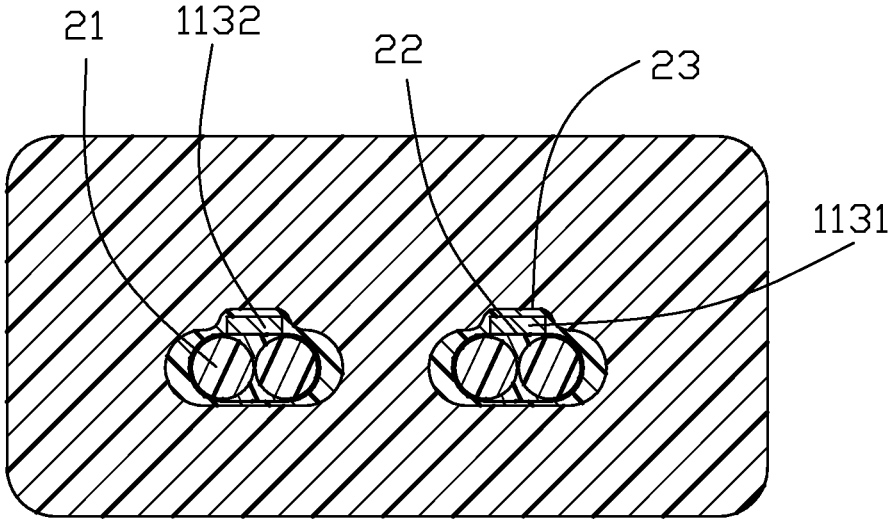
FIG. 6 is a cross section view of the cable connector assembly taken along line 6-6 in FIG. 1.

Referring to FIGS. 1 and 6, a cable connector assembly 100 in accordance with the present invention comprises a connector 1 for mating with a complementary connector (not shown) and a pair of cables 2 electrically connected with the connector 1. The connector 1 shown is a Serial Advanced Technology Attachment connector 1 for signal transmission. In other embodiment, the connector 1 can be other than the Serial Advanced Technology Attachment connector. The connector 1 comprises an insulative housing 10 and a plurality of electrical contacts 11 assembled therein. A spacer 12 is assembled to a rear end of the insulative housing 10 and a cover 13 is integrally molded with the insulative housing 10.

The insulative housing 10 comprises an engaging portion 101 at a front section thereof, a coupling portion 102 at a rear section thereof, a top wall 103, a bottom wall 104, and a pair of side walls 105 connected with the top wall 103 and the bottom wall 104. A block 106 with a rectangular configuration is formed in the insulative housing 10 and extends from the engaging portion 101 to the coupling portion 102. The block 106 is connected with the top wall 103 and one of the side walls 105. A plurality of contact channels 1061 are formed on the block 106 and penetrate through the engaging portion 101 to the coupling portion 102.

A receiving cavity 107 with an L-shaped configuration for receiving a tongue (not shown) of the complementary connector penetrates through the engaging portion 101 to the coupling portion 102. A guiding bar 1051 projects outwardly from the side wall 105 for guiding the connector 10 to mate with the complementary connector properly. A pair of stop portions 108 are projected from the top wall 103 and the bottom wall 105, respectively, for cooperating with the cover 13. A rectangular opening 1021 is depressed inwardly from the coupling portion 102 and communicated with the contact channels 1061.

The electrical contacts 11 are received in corresponding contact channels 1061 and comprise signal contacts 111 and grounding contacts 112 arranged in a same low, plural grounding pins 113, and a connecting portion 114 connected with the grounding contacts 112 and the grounding pins 113. All the grounding contacts 112 are connected on a same connecting portion 114 to achieve an effect of the common grounding connection. The signal contacts 111 and the grounding pins 113 are disposed on opposite sides of the connecting portion 114. Each signal contact 111 comprises a contacting portion 1111 engaged with the complementary connector, a retaining portion 1112 bent extending rearwardly from the contacting portion 1111, and a soldering portion 1113 extending horizontally rearwardly from the retaining portion 1112. Each grounding contact 112 comprises a mating portion 1121, a fixing portion 1122 bent extending rearwardly from the mating portion 1121, and a tail portion 1123 extending horizontally rearwardly from the fixing portion 1122. In the embodiment shown, a pair of signal contacts 111 are used for transmitting a pair of differential signals. Each grounding pin 113 is staggered relative to associated grounding contacts 112. The number of the grounding pins 113 is less than the number of the grounding contacts 112. The grounding pins 113 comprise a first grounding pin 1131 and a second grounding pin 1132 arranged in a same low. The first grounding pin 1131, the second grounding pin 1132, the soldering portions 1113 of the signal contacts 111, the tail portions 1123 of the grounding contacts 112, and the connecting portion 114 are disposed on a same plane. A plurality of barbs 110 are disposed on the signal contacts 111 and the grounding contacts 112. The barbs 110 are used to interference fit with the contact channels 1061 for firmly securing the electrical contacts 11 in the insulative housing 10.

A spacer 12 is generally of a rectangular configuration. A size of the spacer 12 is substantially equal to the opening 1021 of the insulative housing 12. The spacer 12 comprises an upper wall 121, a lower wall 122, and a plurality of holes 123 arranged in a row for the signal contacts 111 and the grounding contacts 112 to pass through. A plurality of ribs 124 are projected from the upper wall 121 and the lower wall 122, respectively. The ribs 124 are engaged with an inner wall of the opening 1021 in order for the spacer 12 to match with the opening 1021 closely.

Each cable 2 comprises two conductive wires 21 defining core wires 211, a grounding layer 22 disposed on an outside of the two core wires, and an outer jacket 23 disposed outside of the grounding layer 22 and surrounding the two conductive wires 21 to expose a front end of the cable 2 to outside. The grounding layer 22 is made of aluminum foil or other conductive materials and comprises a front portion 221 exposed to outside of the outer jacket 23. A width of the front portion 221 is equal to a width of the connecting portion 114 extending in a direction of the cable 2. The core wires 211 are connected with the corresponding signal contacts 111 by soldering. The first grounding pin 1131 and the second grounding pin 1132 are inserted into the corresponding cable 2, respectively, and disposed between the outer jacket 23 and grounding layer 22 along a front-to-back direction. And the cable 2 forms a projecting portion 24 projected outwardly. The projecting portion 24 and the conductive wires 21 are disposed on opposite sides of the connecting portion 114.

The cover 13 is enclosed at a front end of the cable 2 and a rear end of the insulative housing 10 to enhance electrical connection stability of the cable 2 and the electrical contacts 11. The cover 13 comprises a body portion 131 and an extending portion 132 extending from the body portion 131. A width of the extending portion 132 is less than a width of the body portion 131 for being grasped conveniently.

In assembling of the cable connector assembly 100, the electrical contacts 11 may pass through the corresponding holes 123 of the spacer 12 as a terminal module via an insert molding process, and then the spacer 12 is mounted on the opening 1021 of the rear end of the insulative housing 10. The electrical contacts 11 are received on the contact channels 1061, and the soldering portions 1113 of the signal contacts 111 and the tail portions 1123 of the grounding contacts 112 are all extending beyond the contact channels 1061. Then, the first and the second grounding pins are inserted into and disposed between the outer jacket 23 of the corresponding cable 2 and the grounding layer 22 of the corresponding cable 2. The core wires 211 are soldered on the corresponding soldering portions 1113 of the signal contacts 111. Finally, the cover 13 is integrally molded with the insulative housing 10.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable connector assembly comprising:

an insulative housing defining a plurality of passageways extending along a front-to-back direction;

a plurality of contacts disposed in the corresponding passageways, respectively, said contacts including differential pair contacts and grounding contacts alternately arranged with each other along a transverse direction perpendicular to said front-to-back direction, each of said contacts including a front mating section, a rear tail section and a middle retention section;

a connecting portion located and exposed behind the tail sections of said contacts and essentially extending along the transverse direction, said connecting portion further forwardly connected to the tail sections of the grounding contacts while spaced from the tail sections of the differential pair contacts; and a cable located behind the housing and including a plurality of differential pair sets each including a pair of differential wires and a grounding braiding surrounding the pair of differential wires; wherein the pair of differential wires form exposed front ends respectively soldered to the tail sections of the corresponding differential pair contacts while the grounding braiding forms an exposed front end soldered to the connecting portion; wherein said connecting portion further includes unitarily a plurality of rearwardly extending tabs each extending into the differential pair set to mechanically and electrically connect to the grounding braiding of the corresponding differential pair set; wherein each of said rearwardly extending tabs extends into and is protectively hidden within a space between the grounding braiding and an outer jacket of the corresponding differential pair set.

2. The cable connector assembly as claimed in claim 1, wherein the jacket includes a bulged portion to accommodate the tab therein.

3. The cable connector assembly as claimed in claim 1, wherein said tab is coplanar with the connecting portion.

4. The cable connector assembly as claimed in claim 1, wherein an insulative spacer is integrally molded upon the contacts between the tail sections and the retention sections so as to seal a rear side of the housing to uncover the corresponding passageways.

5. The cable connector assembly as claimed in claim 1, wherein the connecting portion is unitarily connected to and formed with the grounding contacts.

6. A cable connector assembly comprising:

an insulative housing defining a plurality of passageways extending along a front-to-back direction;

a plurality of contacts disposed in the corresponding passageways, respectively, said contacts including differential pair contacts and grounding contacts alternately arranged with each other along a transverse direction perpendicular to said front-to-back direction, each of said contacts including a front mating section, a rear tail section and a middle retention section;

a connecting portion located and exposed behind the tail sections of said contacts and essentially extending along the transverse direction, said connecting portion further forwardly unitarily connected to and formed with the tail sections of the grounding contacts while spaced from the tail sections of the differential pair contacts; and an insulative spacer being integrally molded upon the contacts between the tail sections and the retention sections so as to seal a rear side of the housing to uncover the corresponding passageways;

further including a cable located behind the housing and including a plurality of differential pair sets each including a pair of differential wires and a grounding braiding surrounding the pair of differential wires, wherein the differential wires are soldered to the tail sections of the corresponding differential pair contacts, respectively, and the grounding braiding is soldered to the connecting portion; wherein;

a plurality of tabs rearwardly extend unitarily from the transversely extending connecting portion, and the grounding braiding of the corresponding differential pair set is connected to the corresponding one of said tabs; wherein each of the differential pair set includes an outer jacket with a projecting portion protectively enclosing said corresponding one of said tabs.

7. The cable connector assembly as claimed in claim 6, wherein the rearwardly extending tab is inserted into and protectively hidden in a space between the grounding braiding and said outer jacket of the corresponding differential pair set.

* * * * *